US010330372B2

(12) United States Patent
Baker et al.

(10) Patent No.: US 10,330,372 B2
(45) Date of Patent: Jun. 25, 2019

(54) RAIL DOOR STORAGE SYSTEM

(71) Applicant: Electrolux Home Products, Inc., Charlotte, NC (US)

(72) Inventors: Chris A. Baker, Anderson, SC (US); David House, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/426,529

(22) Filed: Feb. 7, 2017

(65) Prior Publication Data

US 2018/0224192 A1 Aug. 9, 2018

(51) Int. Cl.

| | |
|---|---|
| ***A47B 96/06*** | (2006.01) |
| ***F25D 23/04*** | (2006.01) |
| ***F25D 23/06*** | (2006.01) |
| ***F25D 25/02*** | (2006.01) |

(52) U.S. Cl.

CPC ..... *F25D 23/04* (2013.01); *A47B 96/067* (2013.01); *F25D 23/067* (2013.01); *F25D 25/024* (2013.01)

(58) Field of Classification Search

CPC .... A47F 5/0846; A47F 5/0807; A47F 5/0853; F25D 23/04; F25D 23/028; F25D 23/066; F25D 23/067; F25D 25/005; F25D 25/024; A47B 96/067

See application file for complete search history.

(56) References Cited

U.S. PATENT DOCUMENTS

| | | | | |
|---|---|---|---|---|
| 4,186,978 | A * | 2/1980 | Thomson | F25D 23/04 211/80 |
| 4,361,368 | A | 11/1982 | Daniels | |
| 4,429,850 | A | 2/1984 | Weber et al. | |
| 4,934,642 | A | 4/1990 | Baron et al. | |
| 5,018,323 | A | 5/1991 | Clausen | |
| 5,138,803 | A | 8/1992 | Grossen | |
| 5,259,519 | A * | 11/1993 | Lieberman | A47F 5/0853 211/66 |
| 5,306,082 | A | 4/1994 | Karlin et al. | |
| 5,454,997 | A * | 10/1995 | Karlin | B29C 49/18 264/163 |
| 5,507,999 | A | 4/1996 | Copsey et al. | |
| 5,533,311 | A | 7/1996 | Tirrell et al. | |
| 5,549,379 | A * | 8/1996 | Jun | A47B 46/00 211/94.01 |
| 5,716,581 | A | 2/1998 | Tirrell et al. | |
| 5,759,591 | A | 6/1998 | Rhoades et al. | |

(Continued)

FOREIGN PATENT DOCUMENTS

| | | | | |
|---|---|---|---|---|
| EP | 0707184 | A2 * | 4/1996 | A47B 96/067 |
| GB | 2203028 | A * | 10/1988 | F25D 23/04 |

*Primary Examiner* — Daniel J Troy
*Assistant Examiner* — Ryan A Doyle
(74) *Attorney, Agent, or Firm* — Pearne & Gordon LLP

(57) ABSTRACT

A storage system and a refrigeration appliance includes the storage system for storing food items in a temperature-controlled environment. The storage system includes a rail attached to a liner panel. The rail includes at least one mounting structure that is partially embedded within the liner panel. The storage system further includes an accessory. The accessory has an arm extending from a rear surface of the accessory. The accessory is placed in a storage position. The arm is placed between the rail and the liner panel when the accessory is placed in the storage position.

16 Claims, 9 Drawing Sheets

(56) References Cited

U.S. PATENT DOCUMENTS

| | | | | |
|---|---|---|---|---|
| 6,187,252 | B1 | 2/2001 | Rhoades et al. | |
| 6,220,684 | B1 | 4/2001 | Bent et al. | |
| 6,908,163 | B1 * | 6/2005 | Hebeler | F25D 23/04 312/321.5 |
| 7,300,120 | B2 | 11/2007 | Shin | |
| D589,728 | S | 4/2009 | Shaha et al. | |
| 7,748,805 | B2 | 7/2010 | Lucas et al. | |
| 8,083,985 | B2 | 12/2011 | Luisi et al. | |
| 8,360,802 | B2 | 1/2013 | Allard et al. | |
| 8,826,862 | B2 * | 9/2014 | Lee | A47F 5/0838 119/28.5 |
| 8,881,466 | B2 | 11/2014 | Roberts | |
| 9,212,843 | B2 | 12/2015 | Boarman | |
| 9,389,012 | B2 * | 7/2016 | Rackley | F25D 23/028 |
| 9,400,132 | B2 * | 7/2016 | Shrader | F25D 23/02 |
| 9,435,579 | B1 * | 9/2016 | House | F25D 23/028 |
| 9,702,614 | B2 * | 7/2017 | Lim | F25D 23/025 |
| 9,784,494 | B2 * | 10/2017 | Chow | F25D 23/04 |
| 2006/0163985 | A1 * | 7/2006 | Blersch | F25D 23/067 312/408 |
| 2007/0228911 | A1 * | 10/2007 | Kim | F25D 23/067 312/408 |
| 2010/0326122 | A1 * | 12/2010 | Seo | F25D 23/04 62/449 |
| 2014/0300266 | A1 | 10/2014 | Rindlisbach et al. | |
| 2014/0360220 | A1 | 12/2014 | Rackley et al. | |
| 2016/0123655 | A1 | 5/2016 | Chow et al. | |

* cited by examiner

RAIL DOOR STORAGE SYSTEM

FIELD

The present disclosure relates generally to a storage system for a refrigeration appliance, and more specifically to a storage system including a rail, wherein the rail includes at least one mounting structure that is partially embedded within a liner panel so as to integrally secure the rail within the liner panel.

BACKGROUND

One configuration of a conventional refrigeration appliance includes at least one wall, such as a door, to provide access to a fresh food compartment or a freezer compartment, allowing access to the stored items within the refrigeration appliance. Conventional refrigeration appliances typically include accessories, such as shelves or bins, that are mounted to the interior of the door for storing fresh and frozen food items within the compartment. For example, U.S. Pat. App. No. 2014/0360220 to Rackley et al. discloses such a conventional refrigeration appliance. Such a configuration is convenient, as door-mounted bins increase the amount of storage space that is easily accessed by the user, rather than having to reach into the interior areas of the refrigeration appliance. Door-mounted bins can also provide the convenience of configurations beneficial to store items such as bottles, cans, and/or other food or beverage containers.

SUMMARY

The following presents a simplified summary of the disclosure in order to provide a basic understanding of some example aspects described in the detailed description. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

In accordance with a first aspect, a refrigeration appliance comprises a cabinet. The refrigeration appliance further comprises a compartment within the cabinet for storing food items in a refrigerated environment. The refrigeration appliance yet further comprises a refrigeration system for providing a cooling effect within the compartment. The refrigeration appliance still further comprises a wall that is attached to the cabinet, wherein the wall provides access to the compartment. The wall comprises a liner panel and a storage system. The storage system comprises a rail, wherein the rail includes at least one mounting structure that is partially embedded within the liner panel so as to integrally secure the rail within the liner panel. The storage system further comprises an accessory, wherein the accessory includes at least one arm, and wherein at least a portion of the arm is placed between the rail and the liner panel when the accessory is placed in a storage position.

In one example of the first aspect, the liner panel includes at least one liner flange, and the mounting structure comprises a mounting flange. In another example, the liner flange can abut the mounting flange. In still another example of the first aspect, the rail is horizontal.

In a further example of the first aspect, the accessory is selective movable in a horizontal direction along a length of the rail while in the storage position.

In yet another example of the first aspect, the accessory includes a width that is less than the full width of the rail such that the accessory may be selectively moved from side to side along the rail.

In still another example of the first aspect, the rail further includes a horizontal first protrusion on a surface facing the liner panel. In another example, the arm includes a first arm portion and a second arm portion. The second arm portion includes a horizontal second protrusion on a front-facing surface of the second arm portion. In a further example, the first protrusion and the second protrusion are configured to interact such that the first protrusion and the second protrusion create a physical interference when the accessory is placed in or removed from the storage position.

In still a further example of the first aspect, the accessory includes at least one foot extending from the rear surface of the accessory which contacts the liner panel when the accessory is laced into the storage position.

The first aspect can be provided alone or in combination with one or any combination of the examples of the first aspect discussed above.

In accordance with a second aspect, a storage system for storing food items in a temperature-controlled environment may comprise a rail, wherein the rail includes at least one mounting structure that is partially embedded within a liner panel so as to integrally secure the rail within the liner panel. The storage system further comprises an accessory, wherein the accessory includes at least one arm, and wherein at least a portion of the arm is placed between the rail and the liner panel when the accessory is placed in a storage position.

In one example of the second aspect, the liner panel includes at least one liner flange, and the mounting structure comprises a mounting flange. In another example, the liner flange can abut the mounting flange. In still another example of the second aspect, the rail is horizontal.

In another example of the second aspect, the accessory is selectively movable in a horizontal direction along a length of the rail while in the storage position.

In yet another example of the second aspect, the accessory includes a width that is less than the width of the rail such that the accessory may be selectively moved from side to side along the rail.

In a further example of the second aspect, the rail further includes a horizontal first protrusion on a surface facing the liner panel. In another example, the arm includes a first arm portion and a second arm portion, the second arm portion includes a horizontal second protrusion on a front-facing surface of the second arm portion. In still another example, the first protrusion and the second protrusion are configured to interact such that the first protrusion and the second protrusion create a physical interference when the accessory is placed in or removed from the storage position.

In still a further example of the second aspect, the accessory includes at least one foot extending from the rear surface of the accessory which contacts the liner panel when the accessory is placed into the storage position.

The second aspect can be provided alone or in combination with one or any combination of the examples of the second aspect discussed above.

In accordance with a third aspect, a refrigeration appliance comprises a cabinet. The refrigeration appliance further comprises a compartment within the cabinet for storing food items in a refrigerated environment. The refrigeration appliance yet further comprises a refrigeration system for providing a cooling effect within the compartment. The refrigeration appliance still further comprises a door that is attached to the cabinet, wherein the door provides access to the compartment. The door comprises a liner panel, wherein the liner panel includes at least one liner flange. The door further comprises a storage system wherein the storage system comprises a horizontal rail. The horizontal rail includes a mounting flange, wherein the mounting flange abuts the liner flange, thereby partially embedding the rail within the liner panel so as to integrally secure the rail within the liner panel. The storage system further comprises an accessory, wherein the accessory includes at least one arm. The arm is placed between the rail and the liner panel when the accessory is placed in a storage position. The accessory is selectively movable in a horizontal direction along a length of the rail while in the storage position.

It is to be understood that both the foregoing general description and the following detailed description present embodiments of the present disclosure, and are intended to provide an overview or framework for understanding the nature and character of the embodiments as they are described and claimed. The accompanying drawings are included to provide a further understanding of the embodiments, and are incorporated into and constitute a part of this specification. The drawings illustrate various embodiments of the disclosure, and together with the description serve to explain the principles and operations thereof.

BRIEF DESCRIPTION OF THE DRAWINGS

These and other features, aspects and advantages of the present disclosure can be further understood when read with reference to the accompanying drawings.

DETAILED DESCRIPTION

Figure 1:
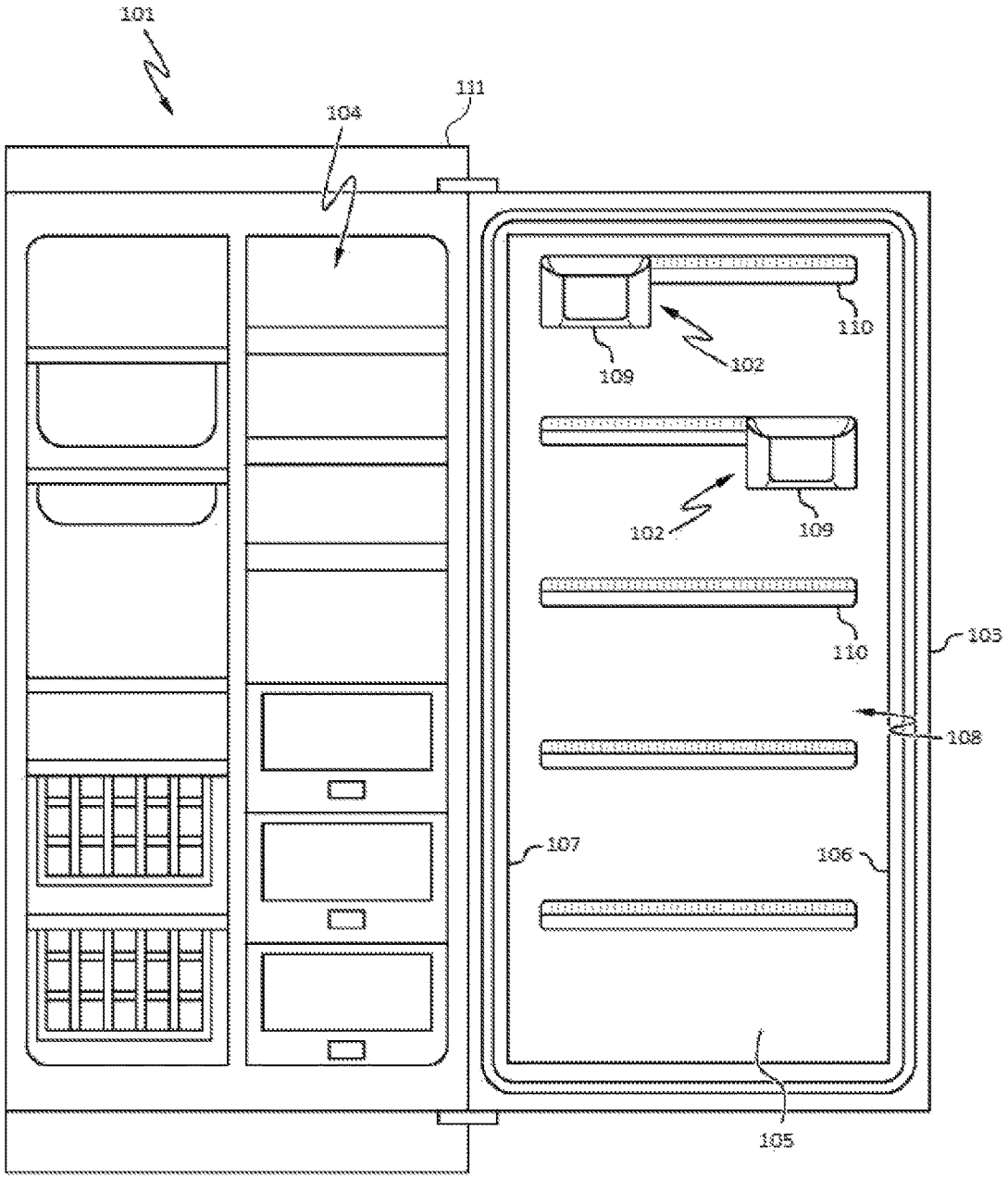
FIG. 1 is a schematic view of a refrigerator including a schematic depiction of an example storage system in accordance with the aspects of the present disclosure.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

FIG. 1 schematically illustrates an example refrigeration appliance such as a refrigerator 101 including an example depiction of a storage system 102 in accordance with aspects of the present invention. It is to be appreciated that the view of FIG. 1 omits some detail of the storage system 102 for simplicity.

The refrigerator 101 can include a cabinet 111. In one example, as shown in FIG. 1, the cabinet 111 can be in the shape of a cuboid. In other examples, the cabinet 111 could be in a different shape (e.g., a cylinder). The cabinet 111 can be hollow, thereby providing a compartment 104 within the refrigerator 101. In further examples, as shown in FIG. 1, the cabinet 111 can include a wall 103. In one example, the wall 103 can be a stationary wall located inside the compartment 104 of the cabinet 111. In another example, as shown in FIG. 1, the wall 103 can be pivotally mounted about a vertical axis to a side of the cabinet 111, thereby acting as a rotatable door, which provides access to the compartment 104. The compartment 104 can include a refrigerator compartment, a freezer compartment, or any other type of compartment. For example, the compartment 104 can be configured for storing food items in a temperature-controlled environment having a target temperature.

The wall 103 can include a plurality of interior walls, such as a rear wall 105, a right wall 106, and a left wall 107. In one example, the rear wall 105, the right wall 106, and the left wall 107 can all be portions of one unitary wall liner component such as a liner panel 108. In one example, the liner panel 108 may comprise a High Impact Polystyrene (HIPS). In another example, the liner panel 108 may be comprised of another suitable material (e.g., Acrylonitrile Butadiene Styrene (ABS), Polyethylene, or Polypropylene). While not shown, the refrigerator 101 can include a refrigeration system for providing a cooling effect within the compartment 104.

The storage system 102 can be configured to be mounted to the wall 103 of the refrigerator 101. In one example, the storage system 102 includes a rail 110 and an accessory 109. In other examples, the storage system 102 can include a plurality of rails 110 and a plurality of accessories 109. As shown, the accessory 109 can be in the form of a bin. In other examples, the accessory 109 can include shelves, for example, a substantially flat surface with walls extending upward from the flat surface. In still further examples, the accessory 109 can include wire-frame constructions configured to hold cans. In yet further examples, the accessory 109 can include other such storage devices configured to house or hold products within the refrigerator 101. The storage system 102 is configured to enable selective horizontal sliding of the accessory 109 along a continuum of locations on the rail 110. FIG. 1 shows a number of storage systems 102 at various elevations of the wall 103.

Figure 2:
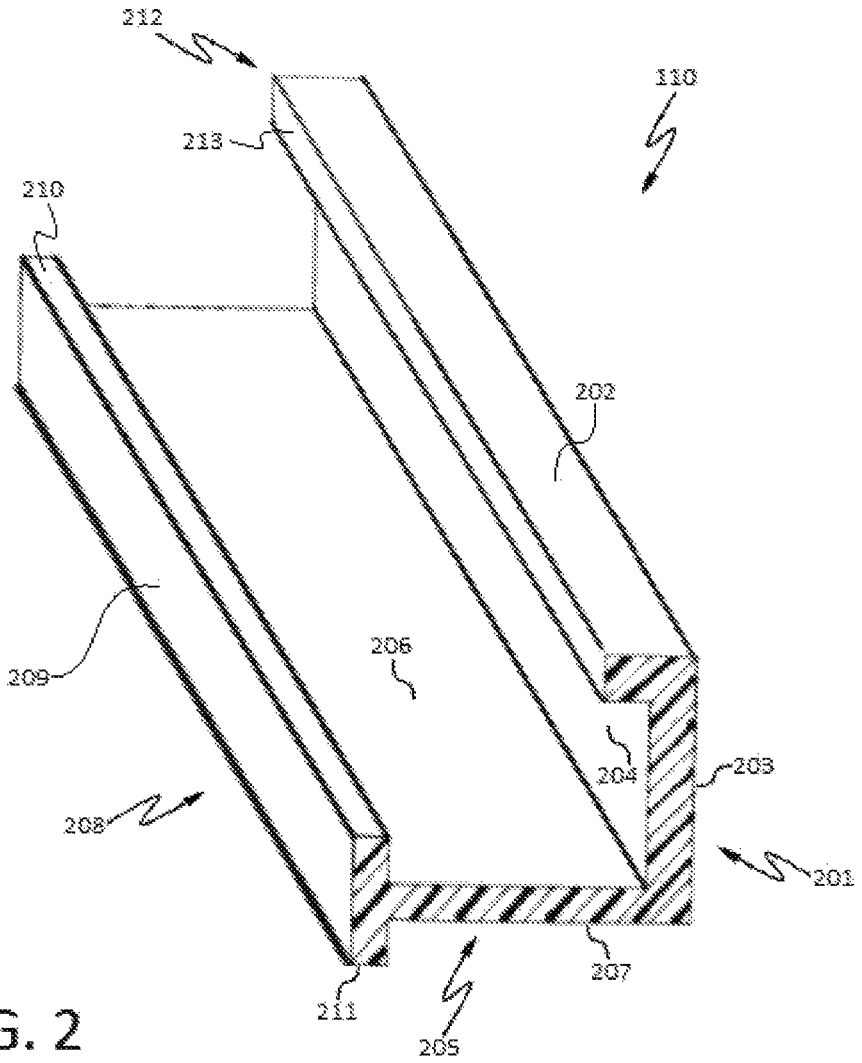
FIG. 2 is a schematic cross-sectional view of an exemplary rail that is included in the storage system.
Figure 3:
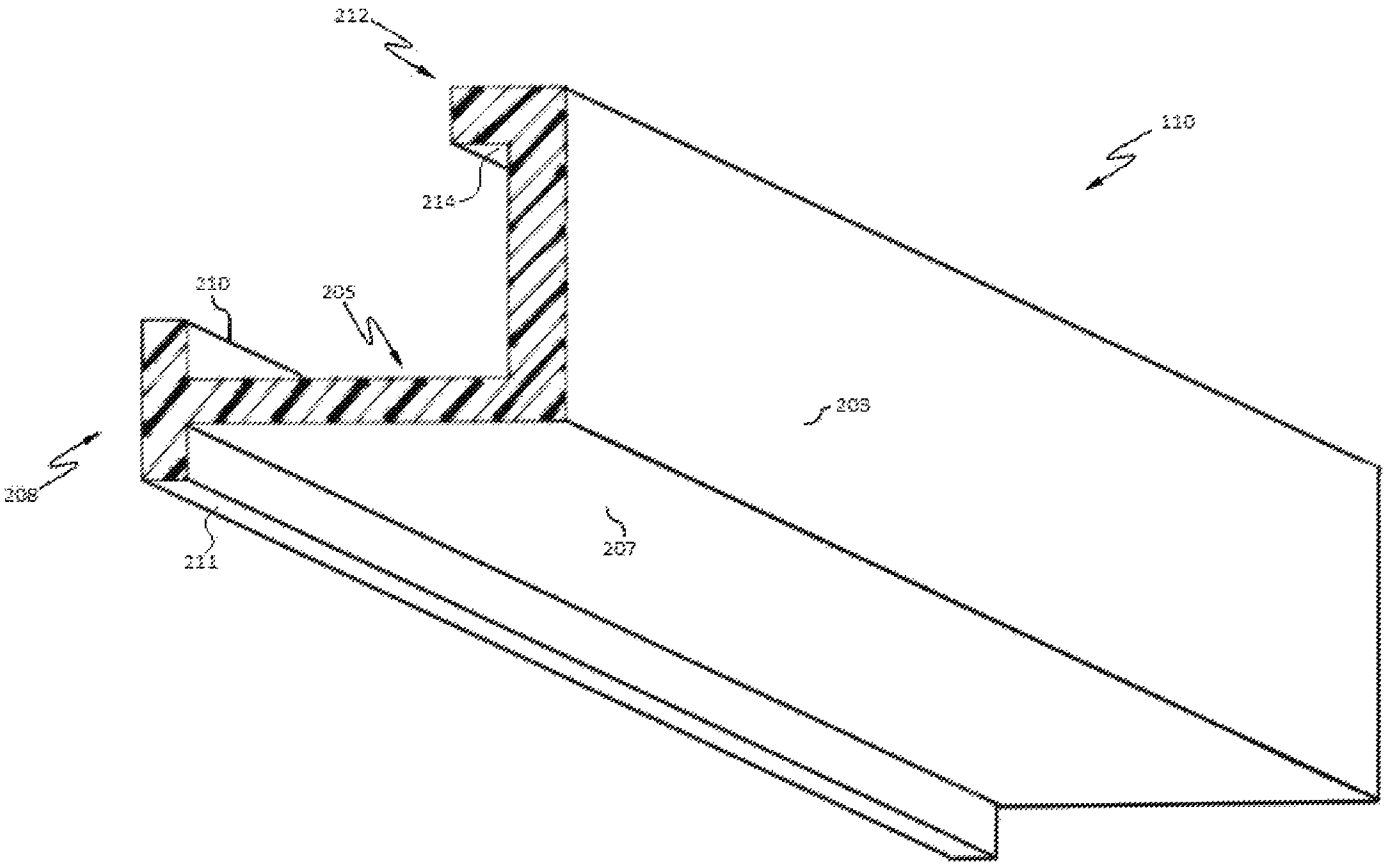
FIG. 3 is a schematic cross-sectional view of an exemplary rail that is included in the storage system.

FIGS. 2 and 3 depict schematic cross-sectional views of an example rail 110 of the storage system 102. As show, the rail 110 includes a substantially vertical portion 201 having a top surface 202, a front-facing surface 203, and a rear-facing surface 204. The substantially vertical portion 201 can be perpendicular, such as at a 90° angle, to a horizontal plane. In other examples, the substantially vertical portion 201 can be at an angle other than 90° to the horizontal plane (e.g., an angle greater than or less than) 90°.

The rail 110 further includes a substantially horizontal portion 205 having a top surface 206, and a bottom surface 207. As shown, the substantially horizontal portion 205 can be perpendicular, such as at a 90° angle, to the substantially vertical portion 201. In other examples, the substantially horizontal portion 205 can be at an angle other than 90° to the substantially vertical portion 201 (e.g., an angle greater than or less than 90°).

Figure 5:
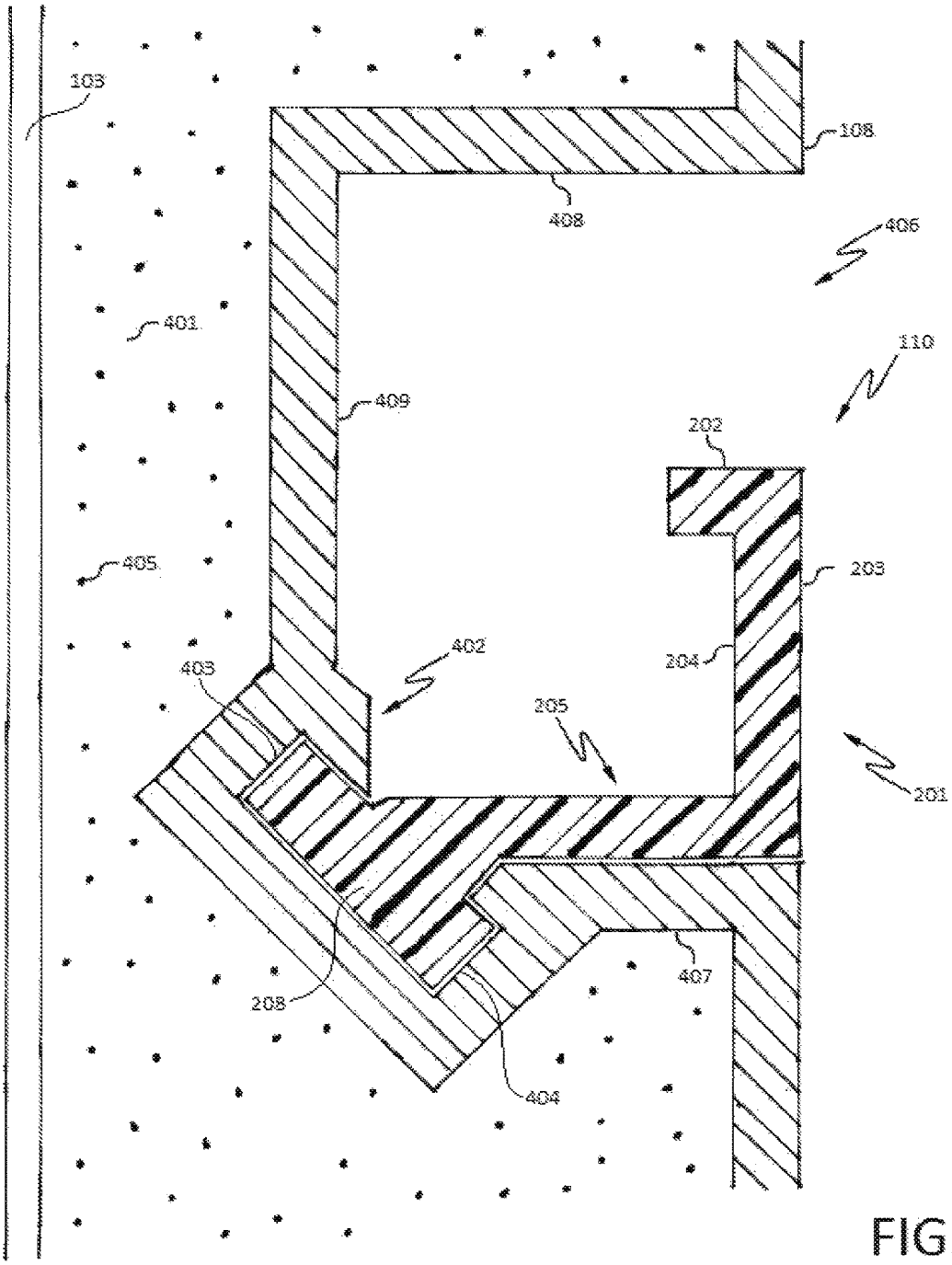
FIG. 5 is a cross-sectional view of another example storage system including a rail that is partially embedded within the liner panel of the refrigerator.

The rail 110 also includes at least one mounting structure. In one example, as shown, the mounting structure can be a mounting flange 208 having a rear-facing surface (i.e., a surface facing the liner) 209, a top portion 210, and a bottom portion 211. In other examples, the mounting flange 208 can include the rear-facing surface 209 and either the top portion 210 or the bottom portion 211. In yet other examples, the mounting flange 208 can be in a shape other than perpendicular to the substantially horizontal portion 205, for example, the mounting flange 208 can be on an angle, as shown in FIG. 5. In still other examples, the mounting structure can be comprised of something other than a flange, for example, a fastener configured to engage with a securing member of the liner panel 108. As shown in FIGS. 2 and 3, the mounting flange 208 can span the entire width of the rail 110. In other examples, the mounting flange 208 can span a distance that is less than the total distance of the rail 110. In further examples, the mounting flange 208 can span a distance that is greater than the total distance of the rail 110. As shown, the mounting flange 208 can be a single flange that spans the distance of the rail 110. In other examples, the mounting structure can comprise a plurality of mounting flanges 208 that are laterally spaced from one another.

The rail 110 can further include a substantially horizontal first protrusion 212 on the rear-facing surface 204 of the substantially vertical portion 201. The substantially horizontal first protrusion 212 can include a rear-facing surface 213 and a bottom surface 214. As shown, the substantially horizontal first protrusion 212 can be perpendicular, such as at a 90° angle, to the substantially vertical portion 201. In other examples, the substantially horizontal first protrusion 212 can be at an angle other than 90° to the substantially vertical portion 201 (e.g., an angle greater than or less than 90°). As shown, the substantially horizontal first protrusion 212 can be located at an upper end of the substantially vertical portion 201. In other examples, the substantially horizontal first protrusion can be located at a different location, such as any location between the upper end of the substantially vertical portion 201 and the top surface 206 of the substantially horizontal portion 205. The substantially horizontal first protrusion 212 is configured to interact with another structure; such interaction will be described more fully below. In one example, the rail 110 can be formed by molded acrylonitrile butadiene styrene (ABS) plastic, for example, the rail could be formed by an extrusion process. In other examples, the rail 110 may be formed by other such suitable materials (e.g., metal) and processes.

Figure 4:
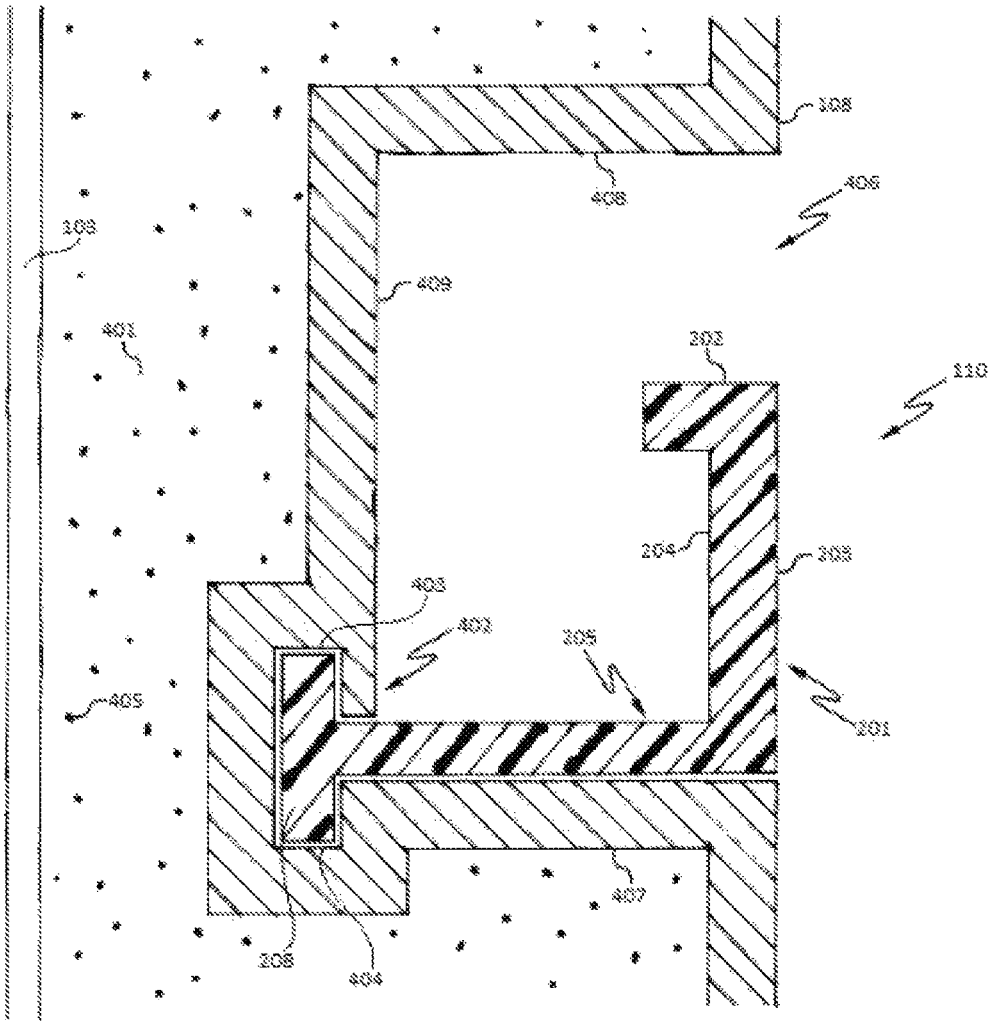
FIG. 4 is a cross-sectional view of an example storage system including a rail that is partially embedded within a liner panel of the refrigerator.

FIG. 4 depicts a cross-sectional view of an exemplary rail 110 according to the present invention. The exemplary depiction overall shows a cross-sectional view of the wall 103 in FIG. 1. As shown, the right side of FIG. 4 represents the interior of compartment 104, or the visible portion of the refrigerator 101 when the wall 103 is in an opened position. The left side of FIG. 4 represents an interior space 401 between the liner panel 108 and the remainder of the wall 103.

As shown, the rail 110 is engaged with and partially embedded within the liner panel 108. This engagement is accomplished by first acquiring plastic pellets or plastic resin. The plastic resin is then heated to a temperature, at or above, the plastic resin's specific melting point. The melted plastic is then formed into a plastic sheet by way of an extrusion process. The plastic sheet is further modified to a desired size. This modification may be completed by a cutting process, a bending process, or any other process suitable for sizing a sheet of material to a desired size. After the plastic sheet has been modified to a desired size, the plastic sheet is then cooled.

Subsequently, the process of engaging the rail 110 within the liner panel 108 includes a vacuum forming operation. The vacuum forming operation includes the steps of acquiring a plastic sheet, and placing said plastic sheet within a machine, wherein the machine secures the plastic sheet at locations around the parameter of the plastic sheet. The central planar surfaces of the plastic sheet are exposed (i.e., not abutting any portion of the machine), on both sides, so that at least one planar surface of the plastic sheet may interact with a mold. The vacuum forming operation further includes the step of heating the plastic sheet, wherein the plastic sheet becomes malleable. Subsequently, the vacuum forming operation further includes the step of interacting at least one planar surface of the plastic sheet with a mold. The vacuum forming operation still further includes the step of introducing the rail 110 to a desired location (i.e., a location wherein the rail's 110 final position is desired) positioned adjacent a planar surface of the plastic sheet. The vacuum forming operation yet further includes the step of introducing a suction force to the mold and the plastic sheet (i.e., turning on a vacuum to create the suction force). The suction force will require a planar surface of the plastic sheet to abut the mold completely, thereby taking the shape of the mold, thus creating the liner panel 108. Furthermore, while the plastic sheet is being formed to the mold, the rail 110 is becoming partially embedded within the plastic sheet by way of the interaction between the rail 110 and the plastic sheet, while the suction force is occurring. The plastic sheet will form around the mounting flange 208 of the rail 110. After the plastic sheet solidifies, thereby creating the liner panel 108, the mounting flange 208 will abut a liner flange 402, and be surrounded by the liner panel 108, thereby integrally securing the rail 110 within the liner panel 108. As shown, the liner flange 402 has a top engaging portion 403 and a bottom-engaging portion 404. The top engaging portion 403 abuts and partially surrounds the top portion 210 of the mounting flange 208. The bottom engaging portion 404 abuts and partially surrounds the bottom portion 211 of the mounting flange 208. Generally, the section of the liner panel 108 abutting the mounting flange 208 will take a shape that surrounds the mounting flange 208; such a phenomena is shown in FIG. 5, which depicts an angled mounting flange 208. As show in FIG. 5, the liner panel 108 forms around the angled mounting flange 208, thus surrounding the angled mounting flange 208, thereby integrally securing the rail 110 within the liner panel 108. Subsequently, after the liner panel 108 has been created, the vacuum forming operation may include the step of cooling the liner panel 108.

It is important to note that the engagement between the mounting flange 208 of the rail 110 and the liner flange 402 of the liner panel 108 allows the rail 110 to be integrally secured within the liner panel 108 without the necessity for additional fasteners. The design further promotes a continual surface area of the liner panel 108 (i.e., the liner panel 108 does not need to be punctured), thereby helping to ensure a proper seal is created between the liner panel 108 and the exterior of wall 103. The interior space 401 can be filled, during manufacturing, with a foaming agent 405, which promotes insulation for the wall 103 and the compartment 104 by way of a rigid foam insulator.

FIGS. 4 and 5 also show the liner panel 108 defining a rectangular shaped cavity 406, which is open on one side to the compartment 104. The liner panel 108 includes a lower horizontally recessed portion 407, an upper horizontally recessed portion 408 and a vertically recessed portion 409, which, with the addition of the liner flange 402, define the rectangular shaped cavity 406. The substantially horizontal portion 205 of the rail 110 can rest on the lower horizontally recessed portion 407 such that the lower horizontally recessed portion 407 gives support to the rail 110 and helps prevent movement of the rail 110, particularly under load. In one example, as shown in FIGS. 4 and 5, it is to be appreciated that the rail 110 can be positioned such that no portion of the rail 110 extends from the cavity 406 into the compartment 104. In this manner, the rail 110 does not needlessly occupy storage space within the compartment 104. In other examples, the rail 110 can be positioned such that a portion of the rail 110 extends beyond the cavity 406.

Figure 6:
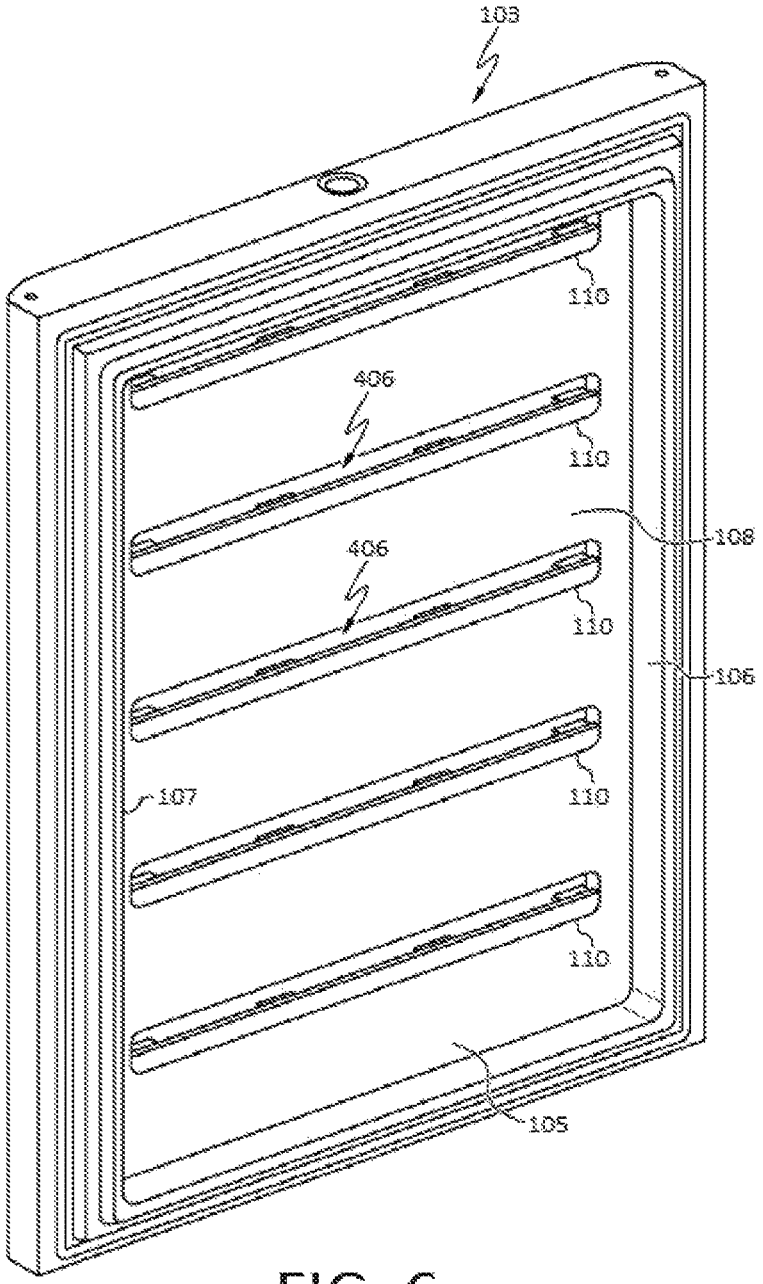
FIG. 6 is a perspective view of a wall of the refrigerator of FIG. 1 including a plurality of rails.

Turning to FIG. 6, the wall 103, as depicted in FIG. 1, is shown from the side that faces the interior of the compartment 104. As such, this is the side of the wall 103 seen by the user when the wall 103 is opened to access the compartment 104 after the refrigerator 101 is fully assembled. As shown, the wall 103 includes five rails 110 that are mounted to the liner panel 108 of the wall 103. In other examples, the wall 103 can include any number of rails 110 that are mounted to the liner panel 108 of the wall 103 in various arrangements.

Figure 7:
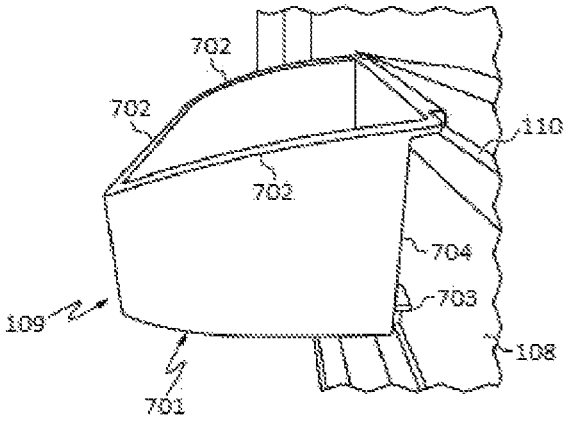
FIG. 7 is a schematic view of an accessory engaged with the rail.

Turning to FIG. 7, the storage system 102 further includes the accessory 109. In this example, the accessory 109 is depicted as a bin for storing food items in a temperature-controlled environment, such as the refrigerator 101. The accessory 109 can include a substantially horizontal platform 701 used as a support surface for supporting various objects, such as items that will be stored in the refrigerator 101. As shown, the substantially horizontal platform 701 can be perpendicular, such as at a 90° angle, to the liner panel 108. In other examples, the substantially horizontal platform 701 can be at an angle other than 90° to the liner panel 108 (e.g., an angle greater than or less than 90°). The substantially horizontal platform 701 can be made of plastic, glass, wire, or any other suitable rigid material. For example, the substantially horizontal platform 701 can be a substantially continuous flat support surface. The substantially horizontal platform 701 can be coupled to a plurality of upwardly extending walls 702 to form an open container configured to receive various object, such as food items. In one example, the plurality of upwardly extending walls 702 can be made of the same material as the substantially horizontal platform 701. In other examples, the plurality of upwardly extending walls 702 can be made of a different material than that of the substantially horizontal platform 701.

The plurality of upwardly extending walls 702 can upwardly extend from the perimeter of the substantially horizontal platform 701 to form a partially enclosed volume. In one example, four upwardly extending walls 702 can extend from the substantially horizontal platform 701, and the upwardly extending walls 702 can include various curves, undulations, etc. to correspond to any number of perimeter shapes of the substantially horizontal platform 701. In another example, the upwardly extending wall 702 facing a user on the exterior of the refrigerator 101 can be shorter than the remaining upwardly extending walls 702 in order to improve access to the space within the accessory 109 and limit necessary lifting required to insert and/or remove objects to and from the accessory 109. In a more particular example, the accessory 109 may not have an upwardly extending wall 702 facing the user.

The accessory 109 further includes at least one foot 703 extending from a rear surface 704 of the accessory 109. The foot 703 contacts the liner panel 108 when the accessory 109 is placed into a storage position as shown in FIG. 7. The foot 703 can help maintain the substantially horizontal platform 701 in a substantially horizontal position. In one example, the foot 703 can also provide friction between the foot 703 and the liner panel 108 to help limit side-to-side movement of the accessory 109 as will be described below. It is to be appreciated that the foot 703, the plurality of upwardly extending walls 702, and the substantially horizontal platform 701 can be made of essentially the same material, for example, plastic, glass, wire, or any other suitable rigid material such as a polystyrene composition. In another example, the foot 703 and the plurality of upwardly extending walls 702 can be molded together with the substantially horizontal platform 701 such that the substantially horizontal platform 701, the plurality of upwardly extending walls 702, and the foot 703 are constructed of one unitary piece.

Figure 8:
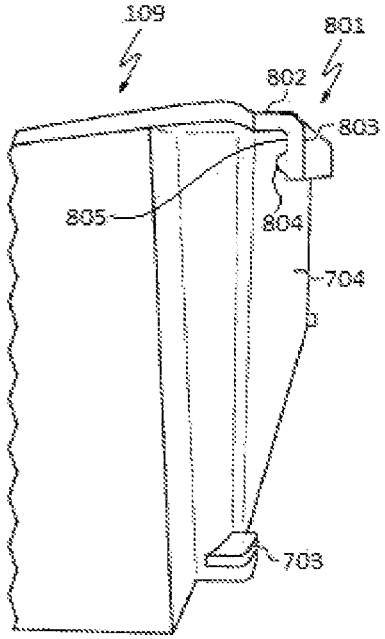
FIG. 8 is a perspective view of the accessory.

Turning to FIG. 8, the accessory 109 still further includes an arm 801 extending from a rear surface (i.e., a surface facing the liner panel) 704 of the accessory 109. The arm 801 can be of any suitable shape or orientation including planar configurations, arcuate configurations such as a hook, etc. As shown in FIG. 8, the arm 801 can include a first arm portion 802. In one example, as shown, the first arm portion 802 can be substantially horizontal. For example, the first arm portion 802 can be perpendicular, such as at a 90° angle, to the rear surface 704 of the accessory 109. In other examples, the first arm portion 802 can be at an angle other than 90° to the rear surface 704 of the accessory 109 (e.g., an angle greater than or less than 90°). While the first arm portion 802 is shown extending from the rear surface 704 of the accessory 109 at the upper most portion of the rear surface 704, the first arm portion 802 can alternatively be placed at any suitable location. The arm 801 can further include a second arm portion 803. In one example, as shown, the second arm portion 803 can be substantially vertical. For example, the second arm portion 803 can be perpendicular, such as at a 90° angle, to the first arm portion 802. In other examples, the second arm portion 803 can be at an angle other than 90° to the first arm portion 802 (e.g., an angle greater than or less than 90°). The second arm portion 803 is configured to be placed between the rail 110 and the liner panel 108 (best shown in FIG. 9) when the accessory 109 is placed in the storage position as shown in FIG. 7. The second arm portion 803 can further include a second protrusion 804 on a front-facing surface 805 of the second arm portion 803. In one example, as shown, the second protrusion 804 can be substantially horizontal. For example, the second protrusion 804 can be perpendicular, such as at a 90° angle, to the second arm portion 803. In other examples, the second protrusion 804 can be at an angle other than 90° to the second arm portion 803 (e.g., an angle greater than or less than 90°).

Figure 9:
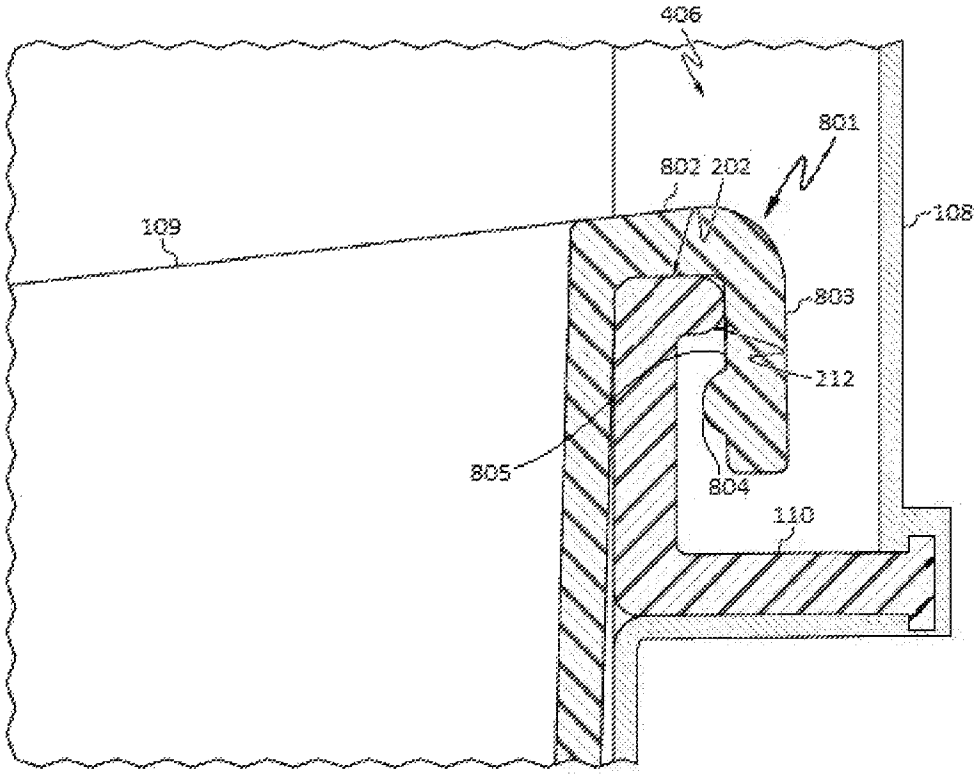
FIG. 9 is cross sectional view of the accessory engaged with the rail.

FIG. 9 shows a detailed cross-sectional view of features of the accessory 109 interacting with features of the rail 110. The accessory 109 is shown in the storage position including the second arm portion 803 placed between the rail 110 and the liner panel 108. In one example, the substantially horizontal first protrusion 212 and the second protrusion 804 are configured to interact with one another. As shown, a distal end of the substantially horizontal first protrusion 212 is relatively close to and/or contacts the front-facing surface 805 of the second arm portion 803. This proximity between the substantially horizontal first protrusion 212 and the second protrusion 804 creates a physical interference when the accessory 109 is placed in or removed from the storage position, as shown in FIG. 9.

This physical interference helps prevent unintentional removal of the accessory 109 from engagement with the rail 110. This physical interference can be overcome by the application of a relatively small amount of force placed upon the accessory 109. When the accessory 109 is in the storage position, an adequate amount of force in the upward direction will elastically deform one or both of the first arm portion 802 and the second arm portion 803 such that the substantially horizontal first protrusion 212 and the second protrusion 804 pass each other. After the substantially horizontal first protrusion 212 and the second protrusion 804 pass each other, the first arm portion 802 and the second arm portion 803 return to their original shape/position. As such, the accessory 109 is disengaged from the rail 110 and can be selectively moved in a lateral direction, or removed from the wall 103 entirely. To place the accessory 109 back into the storage position, the user positions the second arm portion 803 between the rail 110 and the liner panel 108. An adequate amount of force in the downward direction will elastically deform one or both of the first arm portion 802 and the second arm portion 803 such that the substantially horizontal first protrusion 212 and the second protrusion 804 pass each other. After the substantially horizontal first protrusion 212 and the second protrusion 804 pass each other, the first arm portion 802 and the second arm portion 803 return to their original shape/position. As such, the accessory 109 is placed in the storage position.

Additionally, the bottom surface of the first arm portion 802 contacts the top surface 202 of the rail 110. This contact interaction provides a frictional force that can overcome a tendency of the accessory 109 to slide from side-to-side when the wall 103 is opened and closed. In one example, the materials of the first arm portion 802 of the accessory 109 and the top surface 202 of the rail 110 can be selected to give rise to a particular desired coefficient of static friction between the accessory 109 and the rail 110. As previously discussed, the accessory 109 can be constructed of polystyrene and the rail 110 can be constructed of ABS plastic. As shown in FIG. 9, contact can optionally be maintained between the accessory 109 and the rail 110 in other locations as well. As shown in FIG. 7, the foot 703 can also contribute to the frictional force between the accessory 109 and the rail 110.

Figure 10:
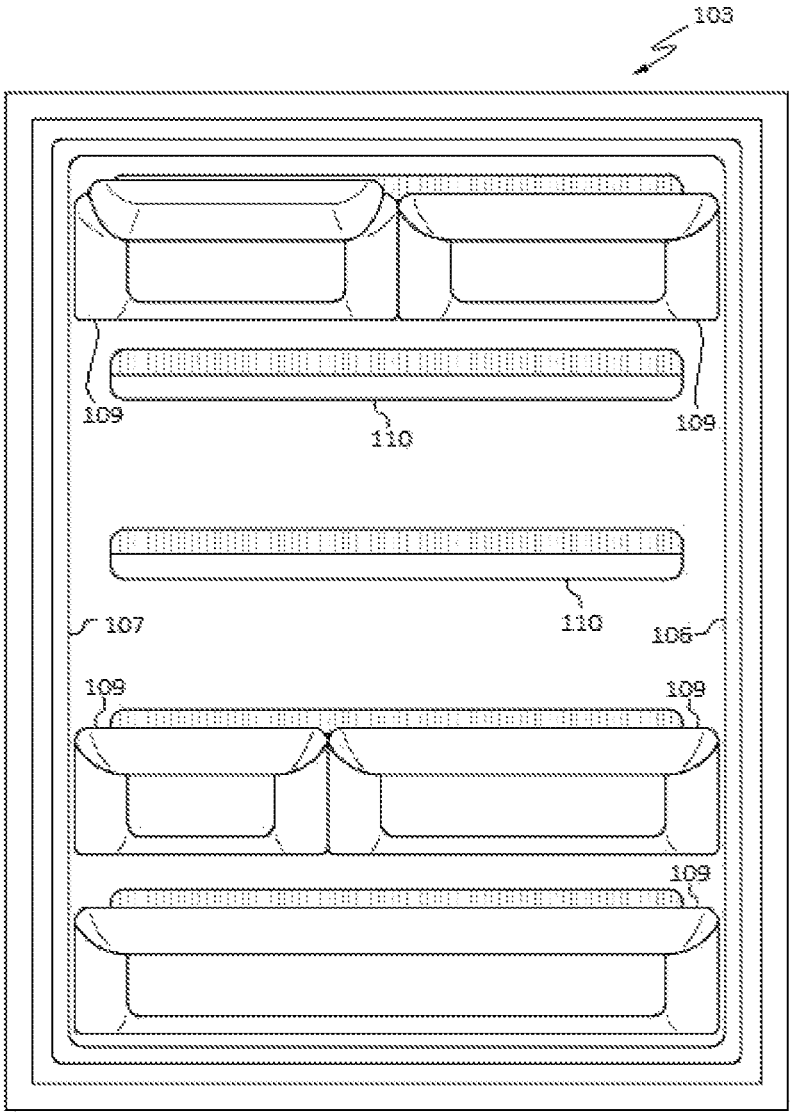
FIG. 10 is a view of the wall of the refrigerator of FIG. 1 including one example arrangement of storage systems and accessories.

Turning to FIG. 10, an interior view of the wall 103, similar to FIG. 6, is shown with a plurality of accessories 109 engaged with a plurality of rails 110. As shown, the accessories 109 can include a width that is less than the full width of the rail 110. As such, the accessory 109 may be selectively moved from side-to-side along the rail 110. The lower-most accessory 109, in this example, extends across substantially the entire available width between the right wall 106 and the left wall 107, though it is appreciated that the width of the accessory 109 can be varied in any of the example accessories 109 as shown in the upper exemplary accessories 109. It is also shown that the accessory 109, when in the storage position, is oriented vertically in relation to the rail 110. While in the storing position, the accessory 109 is selectively movable in a horizontal direction along a length of the rail 110.

Returning to FIG. 9, at such time when a user chooses to move one or more accessories 109 from side-to-side on a rail 110, the friction between the rail 110 and the accessory 109 must be overcome. In such a situation, the user can apply an upward force to the accessory 109 of lesser magnitude than the previously described force required to remove the accessory 109 from the storage position. This force lifts the bottom surface of the first arm portion 802 a relatively short distance away from the top surface 202 of the rail 110. In this position, the substantially horizontal first protrusion 212 and the second protrusion 804 have not passed each other, and contact between the two can supply a tactical indication to the user that the accessory 109 is lifted away from the rail 110 to a satisfactory distance for side-to-side motion. Then, the user applies an additional force in a lateral direction to move the accessory 109 sideways. Once the accessory 109 is in a desired location, the user can remove both forces, at which time, the bottom surface of the first arm portion 802 contacts the top surface 202 of the rail 110, and the bin is returned to the storage position. It is to be appreciated that the accessories 109 can be positioned along a continuum of locations, and the accessory 109 position is not limited by discrete locations such as individual accessory mounts located on the wall 103 or the liner panel 108.

It will be apparent to those skilled in the art that various modifications and variations can be made to the present disclosure without departing from the spirit and scope of the invention. Thus, it is intended that the present invention cover the modifications and variations of this disclosure provided they come within the scope of the appended claims and their equivalents.

What is claimed is:

1. A refrigeration appliance comprising:
- a cabinet;
- a compartment defined within the cabinet;
- a refrigeration system for providing a cooling effect within the compartment;
- a door rotatably secured to the cabinet to provide selective access to said compartment, said door comprising:
  - an external wall;
  - a liner attached to the external wall such that an internal space of the door is defined therebetween, the liner including a cavity open to the compartment and having upper and lower walls oriented horizontally with respect to the external wall of the door, a vertical wall extending downwards from the upper wall to the lower wall, and a chamber formed in at least the vertical wall of the cavity; and
  - a rigid foam insulation disposed in the internal space of the door; and
- a storage system comprising:
  - a rail disposed adjacent the liner on a side being opposite to the internal space and open to the compartment, the rail having a mounting flange that is surrounded by the chamber of the liner to integrally secure the rail with the liner, and the rail being kept separate from the rigid foam insulation by the chamber; and
  - an accessory having an arm, wherein a segment of the arm is located between the rail and the liner to thereby support the accessory upon the rail when the accessory is placed in a storage position.

2. The refrigeration appliance according to claim 1, wherein the rail is horizontal.

3. The refrigeration appliance according to claim 1, wherein the accessory is selectively movable in a horizontal direction along a length of the rail while in the storage position.

4. The refrigeration appliance according to claim 1, wherein the accessory includes a width that is less than a full width of the rail such that the accessory may be selectively moved from side to side along the rail.

5. The refrigeration appliance according to claim 1, wherein the rail further includes a horizontal first protrusion on a surface facing the liner.

6. The refrigeration appliance according to claim 5, wherein the arm includes a first arm portion extending horizontally from a rear surface of the accessory towards the liner and a second arm portion extending from and perpendicular to the first arm portion, the second arm portion defined as the segment of the arm placed between the rail and the liner, and wherein the second arm portion includes a horizontal second protrusion on a front-facing surface of the second arm portion.

7. The refrigeration appliance according to claim 6, wherein the first protrusion and the second protrusion are configured to interact such that the first protrusion and the second protrusion create a physical interference when the accessory is placed in or removed from the storage position.

8. The refrigeration appliance according to claim 1, wherein the accessory includes at least one foot extending from the rear surface of the accessory which contacts the liner when the accessory is placed into the storage position.

9. A storage system for storing food items in a temperature-controlled environment, the storage system comprising:

an external wall;

a liner attached to the external wall such that an internal space is defined therebetween, the liner including a cavity having upper and lower walls oriented horizontally with respect to the external wall, a vertical wall extending downwards from the upper wall to the lower wall, and a chamber formed in at least the vertical wall of the cavity;

a rigid foam insulation disposed within the internal space;

a rail disposed adjacent the liner on a side being opposite to the internal space, the rail having a mounting flange that is surrounded by the chamber of the liner to integrally secure the rail with the liner, and the rail being kept separate from the rigid foam insulation by the chamber; and an accessory having an arm, wherein a segment of the arm is located between the rail and the liner to thereby support the accessory upon the rail when the accessory is placed in a storage position.

10. The storage system according to claim 9, wherein the accessory is selectively movable in a horizontal direction along a length of the rail while in the storage position.

11. The storage system according to claim 9, wherein the accessory includes a width that is less than a full width of the rail such that the accessory may be selectively moved from side to side along the rail.

12. The storage system according to claim 9, wherein the rail further includes a horizontal first protrusion on a surface facing the liner.

13. The storage system according to claim 12, wherein the arm includes a first arm portion extending horizontally from a rear surface of the accessory towards the liner and a second arm portion extending from and perpendicular to the first arm portion, the second arm portion defined as the segment of the arm placed between the rail and the liner, and wherein the second arm portion includes a horizontal second protrusion on a front-facing surface of the second arm portion.

14. The storage system according to claim 13, wherein the first protrusion and the second protrusion are configured to interact such that the first protrusion and the second protrusion create a physical interference when the accessory is placed in or removed from the storage position.

15. The storage system according to claim 9, wherein the accessory includes at least one foot extending from the rear surface of the accessory which contacts the liner when the accessory is placed into the storage position.

16. A refrigeration appliance comprising:

a cabinet;

a compartment defined within the cabinet;

a refrigeration system for providing a cooling effect within the compartment;

a door rotatably secured to the cabinet to provide selective access to said compartment, the door comprising:

an external wall;

a liner attached to the external wall such that an internal space of the door is defined therebetween, the liner including a cavity open to the compartment and having upper and lower walls oriented horizontally with respect to the external wall of the door, a vertical wall extending downwards from the upper wall to the lower wall, and a chamber formed in at least the vertical wall of the cavity; and a rigid foam insulation disposed in the internal space of the door; and a storage system comprising:

a horizontal rail disposed adjacent the liner on a side being opposite to the internal space and open to the compartment, the rail having a mounting flange having at least one engaging portion that is surrounded by the chamber of the liner to integrally secure the rail with the liner, and the rail being kept separate from the rigid foam insulation by the chamber; and an accessory having an arm, wherein a segment of the arm is located between the rail and the liner to thereby support the accessory upon the rail when the accessory is placed in a storage position, and wherein the accessory is selectively movable in a horizontal direction along a length of the rail while in the storage position.

* * * * *